US011448041B2

(12) United States Patent
Kuhlman et al.

(10) Patent No.: US 11,448,041 B2
(45) Date of Patent: Sep. 20, 2022

(54) DRILLABLE WINDOW ASSEMBLY FOR CONTROLLING THE GEOMETRY OF A MULTILATERAL WELLBORE JUNCTION

(71) Applicant: Halliburton Energy Services, Inc., Houston, TX (US)

(72) Inventors: Michael Werner Kuhlman, Kingwood, TX (US); Neil Hepburn, Newcastle-upon-Tyne (GB); Franklin Charles Rodriguez, Stavanger (NO); Stuart Alexander Telfer, Stonehaven (GB)

(73) Assignee: Halliburton Energy Services, Inc., Houston, TX (US)

( * ) Notice: Subject to any disclaimer, the term of this patent is extended or adjusted under 35 U.S.C. 154(b) by 9 days.

(21) Appl. No.: 16/940,507

(22) Filed: Jul. 28, 2020

(65) Prior Publication Data

US 2021/0047901 A1 Feb. 18, 2021

Related U.S. Application Data

(60) Provisional application No. 62/885,886, filed on Aug. 13, 2019.

(51) Int. Cl.

| | |
|---|---|
| ***E21B 41/00*** | (2006.01) |
| ***E21B 7/04*** | (2006.01) |
| ***E21B 29/06*** | (2006.01) |
| ***E21B 17/00*** | (2006.01) |

(52) U.S. Cl.

CPC ..... *E21B 41/0035* (2013.01); *E21B 7/04* (2013.01); *E21B 17/00* (2013.01); *E21B 29/06* (2013.01)

(58) Field of Classification Search

CPC ..... E21B 41/0035; E21B 7/04; E21B 17/00; E21B 29/06; E21B 7/067

See application file for complete search history.

(56) References Cited

U.S. PATENT DOCUMENTS

| | | | | |
|---|---|---|---|---|
| 4,813,497 | A | 3/1989 | Wenzel | |
| 4,962,818 | A * | 10/1990 | DeLucia | E21B 4/02 175/107 |
| 5,042,597 | A | 8/1991 | Rehm et al. | |
| 5,458,209 | A * | 10/1995 | Hayes | E21B 7/061 175/61 |

(Continued)

FOREIGN PATENT DOCUMENTS

| | | | |
|---|---|---|---|
| CA | 2724581 | A1 | 11/2009 |
| CA | 2792999 | C | 10/2014 |

(Continued)

*Primary Examiner* — Jonathan Malikasim

(74) *Attorney, Agent, or Firm* — Scott Richardson; Parker Justiss, P.C.

(57) ABSTRACT

Provided, in one aspect, is a drillable window assembly. The drillable window assembly, in this aspect, includes a first precut casing joint, the first precut casing joint including a first casing tubular having two or more radially offset slots along an interior surface thereof, and a second precut casing joint coupled to the first precut casing joint, the second precut casing joint including a second casing tubular having a sidewall opening formed therein. The drillable window assembly, as contained within this aspect, further includes an outer sleeve surrounding the sidewall opening in the second casing tubular.

20 Claims, 14 Drawing Sheets

(56) References Cited

U.S. PATENT DOCUMENTS

| | | | | |
|---|---|---|---|---|
| 5,584,350 | A | 12/1996 | Schnitker et al. | |
| 5,785,133 | A * | 7/1998 | Murray | E21B 7/061 166/117.5 |
| 5,884,698 | A | 3/1999 | Hughes et al. | |
| 6,070,665 | A | 6/2000 | Singleton et al. | |
| 6,267,179 | B1 | 7/2001 | Ohmer et al. | |
| 6,568,492 | B2 | 5/2003 | Thigpen et al. | |
| 6,848,504 | B2 * | 2/2005 | Brunet | E21B 41/0042 166/117.5 |
| 7,308,940 | B2 | 12/2007 | Vuyk et al. | |
| 8,505,621 | B2 | 8/2013 | Telfer et al. | |
| 8,763,685 | B2 | 7/2014 | Robin | |
| 8,967,266 | B2 | 3/2015 | Parlin et al. | |
| 9,033,059 | B2 * | 5/2015 | Steele | E21B 17/18 166/381 |
| 9,394,753 | B2 * | 7/2016 | Hurtado | E21B 41/0035 |
| 10,731,417 | B2 | 8/2020 | Vemuri et al. | |
| 2002/0003040 | A1 | 1/2002 | Brunet | |
| 2004/0016547 | A1 | 1/2004 | Brunet et al. | |
| 2005/0006100 | A1 | 1/2005 | Murray et al. | |
| 2006/0137874 | A1 | 6/2006 | Araque et al. | |
| 2011/0240282 | A1 | 10/2011 | Telfer et al. | |
| 2015/0047840 | A1 | 2/2015 | Hurtado | |
| 2018/0274300 | A1 | 9/2018 | Vemuri et al. | |
| 2018/0363401 | A1 | 12/2018 | Van der Veen et al. | |

FOREIGN PATENT DOCUMENTS

| | | | |
|---|---|---|---|
| CN | 108678668 | A | 10/2018 |
| GB | 1320146 | | 6/1973 |
| GB | 2406595 | A | 6/2005 |
| RU | 2147666 | C1 | 4/2000 |
| RU | 2687729 | C1 | 5/2019 |

* cited by examiner

DRILLABLE WINDOW ASSEMBLY FOR CONTROLLING THE GEOMETRY OF A MULTILATERAL WELLBORE JUNCTION

CROSS-REFERENCE TO RELATED APPLICATION

This application claims the benefit of U.S. Provisional Application Ser. No. 62/885,886, filed on Aug. 13, 2019, and entitled "METHOD AND APPARATUS FOR CONTROLLING THE GEOMETRY OF A LOW SIDE MILLED EXIT USED IN MULTILATERAL WELLBORE JUNCTION CONSTRUCTION," commonly assigned with this application and incorporated herein by reference in its entirety.

BACKGROUND

The unconventional market is very competitive. The market is trending towards longer horizontal wells to increase reservoir contact. Multilateral wellbores offer an alternative approach to maximize reservoir contact. Multilateral wellbores include one or more lateral wellbores extending from a main wellbore. A lateral wellbore is a wellbore that is diverted from the main wellbore from a first general direction to a second general direction.

A multilateral wellbore can include one or more windows or casing exits to allow corresponding lateral wellbores to be formed. The window or casing exit for a multilateral wellbore can traditionally be formed by positioning a solid whipstock assembly in a casing string with a running tool at a desired location in the main wellbore. The whipstock assembly may be used to deflect a window mill relative to the casing string. The deflected window mill penetrates part of the casing joint to form the window or casing exit in the casing string and is then withdrawn from the wellbore. Drilling assemblies can be subsequently inserted through the casing exit in order to drill the lateral wellbore.

Traditional multilateral wellbore construction does not integrate well with the unconventional frac market. For example, traditional multilateral wellbore construction designs and re-entry methods add significant additional cost to the overall well construction cost, such that multilateral wells may not be not an economically viable solution when compared to multiple single wells. What is needed in the art is a new well construction method and tools that reduces the number of multilateral junction construction operations required, and to minimize the requirement for additional workover rig days, by providing a simplified selective access solution for 2 or more laterals for carrying out any frac operations required.

BRIEF DESCRIPTION

Reference is now made to the following descriptions taken in conjunction with the accompanying drawings, in which.

DETAILED DESCRIPTION

A subterranean formation containing oil or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

While a main wellbore may in some instances be formed in a substantially vertical orientation relative to a surface of the well, and while the lateral wellbore may in some instances be formed in a substantially horizontal orientation relative to the surface of the well, reference herein to either the main wellbore or the lateral wellbore is not meant to imply any particular orientation, and the orientation of each of these wellbores may include portions that are vertical, non-vertical, horizontal or non-horizontal. Further, the term "uphole" refers a direction that is towards the surface of the well, while the term "downhole" refers a direction that is away from the surface of the well.

Figure 1:
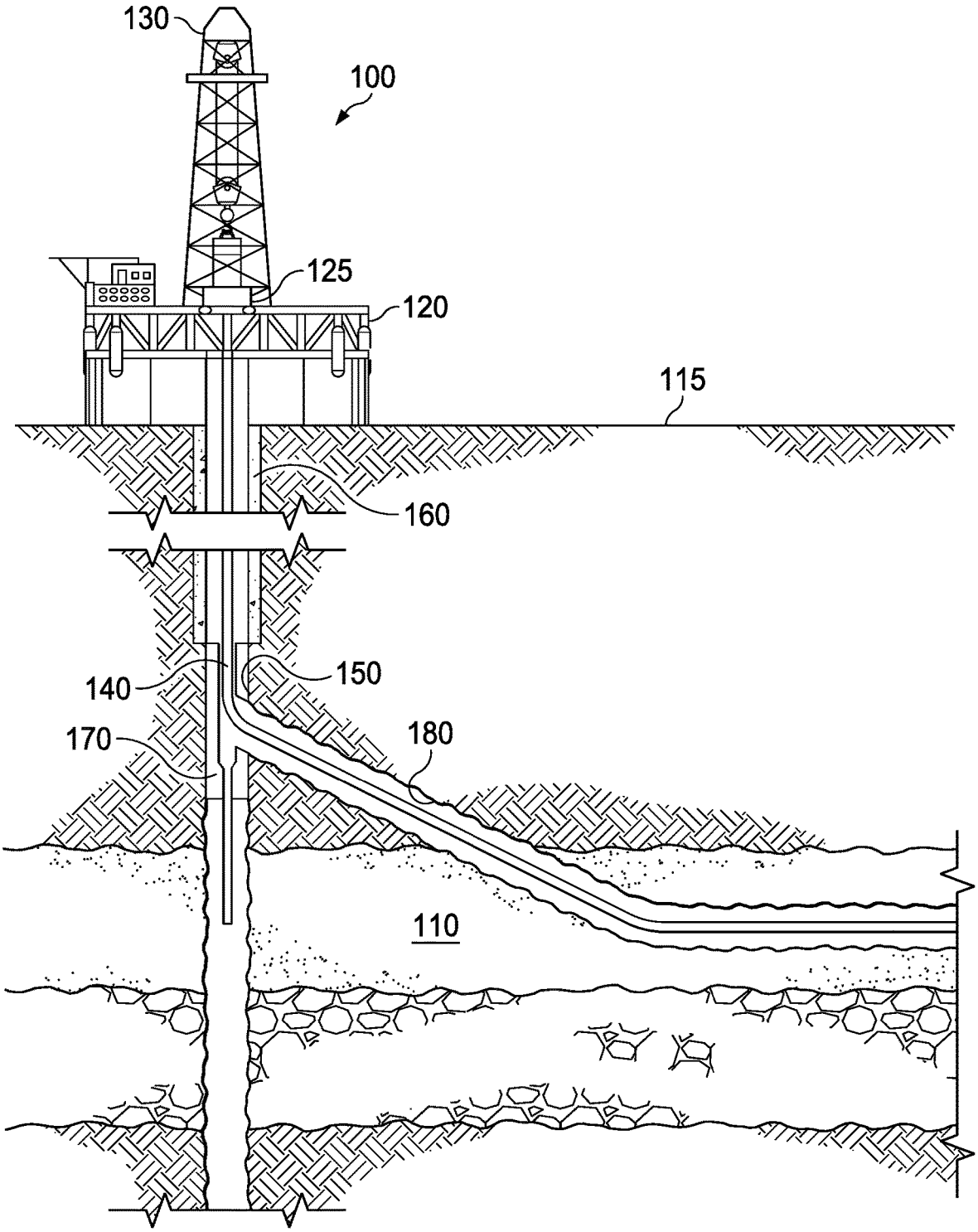
FIG. 1 is a schematic view of an oil and gas system according to one or more embodiments disclosed herein.

FIG. 1 is a schematic view of a multilateral well 100, according to one or more embodiments disclosed herein. The multilateral well 100 includes a platform 120 positioned over an oil and gas formation 110 located below the earth's surface 115. The platform 120 has a hoisting apparatus 125 and a derrick 130 for raising and lowering pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based oil and gas wells and/or offshore oil and gas wells different from that illustrated.

As shown, a main wellbore 150 has been drilled through the various earth strata, including the formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as "liner" and may be made of any material, such as steel or composite material and may be segmented or continuous, such as coiled tubing.

A drillable window assembly 170 designed, manufactured and operated according to one or more embodiments of the disclosure may be positioned at a desired intersection between the main wellbore 150 and a lateral wellbore 180. The drillable window assembly 170, in one embodiment, includes a first precut casing joint, the first precut casing joint including a first casing tubular having two or more radially offset slots along an interior thereof. The drillable window assembly 170, according to this embodiment, further includes a second precut casing joint coupled to the first precut casing joint, the second precut casing joint including a second casing tubular having a sidewall opening formed therein. Further to this embodiment, the drillable window assembly 170 includes an outer sleeve surrounding the sidewall opening. The outer sleeve, in one embodiment, is a non-ferrous outer sleeve. In another embodiment, the outer sleeve is a low yield steel, aluminum, composites, plastics etc., that has a hardness less (e.g., substantially less—less than 50%) than a hardness of the casing tubular. Accordingly, what is provided in one embodiment is a drillable window assembly that may provide a low side exit with bilateral keyed offset sub assembly. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

Figure 2A:
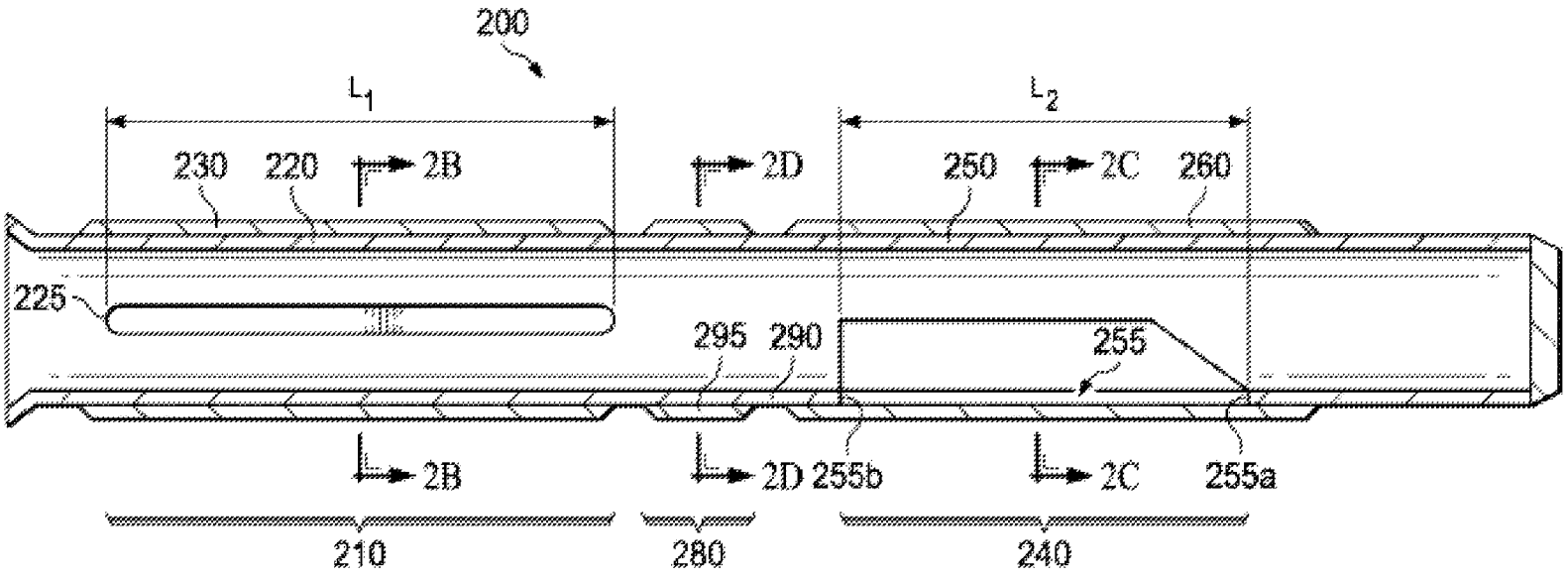
FIGS. 2A through 2D illustrate one embodiment of a drillable window assembly designed and manufactured according to one embodiment of the disclosure.

Turning now to FIG. 2A, illustrated is an enlarged cross-sectional view of a drillable window assembly 200 designed and manufactured according to one or more embodiments of the disclosure. The drillable window assembly 200, in one embodiment, could be used as the drillable window assembly 170 illustrated in FIG. 1. The drillable window assembly 200, in one or more embodiments, includes a first precut casing joint 210 coupled to a second precut casing joint 240. In the illustrated embodiment of FIG. 2A, the first precut casing joint 210 is located proximate an uphole end of the drillable window assembly 200, the second precut casing joint 240 is located proximate a downhole end of the drillable window assembly 200, and a casing alignment sub 280 is located there between.

The first precut casing joint 210, in accordance with one embodiment, includes a first casing tubular 220. The first casing tubular 220, in accordance with one embodiment of the disclosure, comprises a metal tubular, such as a steel tubular. While the first casing tubular 220 has been described as comprising metal, other materials may be used for the first casing tubular 220 and remain within the scope of the disclosure.

In accordance with one or more embodiments of the disclosure, the first casing tubular 220 may have two or more radially offset slots 225 positioned along an interior thereof. In one embodiment, the two or more radially offset slots 225 are positioned substantially equidistance around the first casing tubular 220. Thus, in accordance with the embodiment shown, the two radially offset slots 225 are positioned apart by about 180 degrees. If the first casing tubular were to include three radially offset slots 225, the three radially offset slots 225 would be positioned apart by about 120 degrees in one particular embodiment. The two or more radially offset slots 225, in one embodiment, may have a length ($L_1$). The length ($L_1$) may range from an entire length of the first casing tubular 220 to less than an entire length of the first casing tubular 220. In one embodiment, however, the length ($L_1$) ranges from about 10 feet to about 20 feet. In yet another embodiment, the length ($L_1$) ranges from about 14 feet to about 16 feet, and is more particularly about 15 feet. Notwithstanding, other lengths ($L_1$) are within the scope of the disclosure.

The first precut casing joint 210, in the illustrated embodiment of FIG. 2A, additionally includes a first outer sleeve 230 surrounding at least a portion of the first casing tubular 220. In one embodiment, the first outer sleeve 230 surrounds an entirety of the first casing tubular 220. The first outer sleeve 230 may comprise many different non-ferrous materials and remain within the scope of the disclosure. In another embodiment, the first outer sleeve 230 comprises a material having a lesser hardness rating than first casing tubular 220. In one embodiment, the first outer sleeve 230 comprises aluminum or an alloy thereof. Notwithstanding, other materials for the first outer sleeve 230 are within the scope of the disclosure.

Figure 2D:
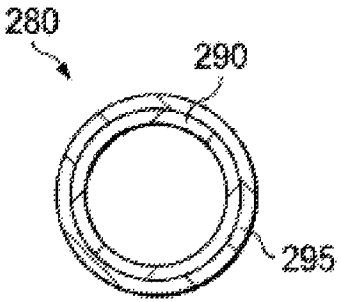
Figure 2C:
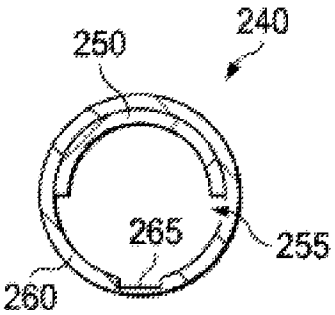
Figure 2B:
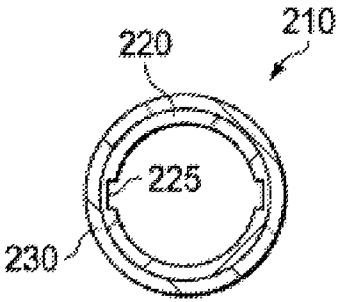

Turning briefly to FIG. 2B, illustrated is a cross sectional view of the first precut casing joint 210 taken through the line 2B-2B illustrated in FIG. 2A. The first precut casing joint 210 includes the first casing tubular 220 and the first outer sleeve 230. Further to this embodiment, the two or more radially offset slots 225 are formed along an interior surface of the first casing tubular 220. In the illustrated embodiment of FIG. 2B, the two or more radially offset slots 225 do not extend entirely through the first casing tubular 220. In alternative embodiments, however, the two or more radially offset slots 225 do extend entirely through the first casing tubular 220. If the two or more radially offset slots 225 do extend entirely through the first casing tubular 220, the first outer sleeve 230 will assist in keeping the exposed two or more radially offset slots 225 free of debris as the drillable window assembly 200 is positioned in the wellbore. The two or more radially offset slots 225 may have a rectangular shape in one or more embodiments of the disclosure. In other embodiments, the two or more radially offset slots 225 have a semi-circular shape, or in yet another embodiment another polygonal shape. Accordingly, unless otherwise required, a shape of the two or more radially offset slots 225 is not limited to one specific shape.

Returning to FIG. 2A, the second precut casing joint 240, in accordance with one embodiment, includes a second casing tubular 250. The second casing tubular 250, in accordance with one embodiment of the disclosure, comprises a metal tubular, such as a steel tubular. While the second casing tubular 250 has been described as comprising metal, other materials may be used for the second casing tubular 250 and remain within the scope of the disclosure.

In accordance with one or more embodiments of the disclosure, the second casing tubular 250 may have a sidewall opening 255 formed therein. The sidewall opening 255, in accordance with one embodiment extends entirely through the second casing tubular 250, and includes a downhole end 255*a* and an uphole end 255*b*. The sidewall opening 255, in one embodiment, may have a length ($L_2$). The length ($L_2$) may range from substantially an entire length of the second casing tubular 250 to less than an entire length of the second casing tubular 250. In one embodiment, however, the length ($L_2$) of the sidewall opening is at least 20 percent of a length of the second casing tubular. Notwithstanding, other lengths ($L_2$) are within the scope of the disclosure.

The sidewall opening 255, in one or more embodiments of the disclosure, is radially offset from the two or more radially offset slots 225 in the first casing tubular 220. In the embodiment of FIG. 2A, a radial centerpoint of the sidewall opening 255 is substantially equally radially offset from two of the two or more radially offset slots 225. Thus for example, if the two or more radially offset slots 225 were to be located at 90 degrees and 270 degrees, respectively, a radial centerpoint of the sidewall opening 255 would be located at approximately 0 degrees or 180 degrees. Nevertheless, other radial configurations are within the scope of the disclosure.

The second precut casing joint 240, in the illustrated embodiment of FIG. 2A, additionally includes a second outer sleeve 260 surrounding the sidewall opening 255 in the second casing tubular 250. In other embodiments, the second outer sleeve 260 surrounds an entirety of the second casing tubular 250. The second outer sleeve 260 may comprise many different non-ferrous materials and remain within the scope of the disclosure. In another embodiment, the second outer sleeve 260 comprises a material having a lesser hardness rating than the second casing tubular 250. In one embodiment, the second outer sleeve 260 comprises aluminum or an alloy thereof. Notwithstanding, other materials for the second outer sleeve 260 are within the scope of the disclosure.

Turning briefly to FIG. 2C, illustrated is a cross sectional view of the second precut casing joint 240 taken through the line 2C-2C illustrated in FIG. 2A. The second precut casing joint 240 includes the second casing tubular 250 and the second outer sleeve 260. Further to this embodiment, the sidewall opening 255 is formed in the second casing tubular 250. In the illustrated embodiment of FIG. 2B, the sidewall opening 255 extends entirely through the second casing tubular 250. In alternative embodiments, however, the sidewall opening 255 does not extend entirely through the second casing tubular 250.

In certain embodiments, the second outer sleeve 260 includes an internal cutaway relief 265 proximate the sidewall opening 255. In the embodiment shown in FIG. 2C, the internal cutaway relief 265 does not extend entirely through the second outer sleeve 260. While a thickness of the second outer sleeve 260 at the internal cutaway relief 265 has been reduced, and thus can be more easily removed, the second outer sleeve 260 still has the ability to prevent debris from entering the sidewall opening 255 as the drillable window assembly is being positioned within the wellbore. In other embodiments, as shown, the internal cutaway relief 265 is an outer sleeve slot located along an inner surface of the second outer sleeve 260.

As shown in FIG. 2D, the casing alignment sub 280, in accordance with one embodiment, includes a third casing tubular 290. The third casing tubular 290, in accordance with one embodiment of the disclosure, comprises a metal tubular, such as a steel tubular. While the third casing tubular 290 has been described as comprising metal, other materials may be used for the third casing tubular 290 and remain within the scope of the disclosure. In certain embodiments, the first, second and third casing tubulars 220, 250, 290 comprise three separate casing tubulars. In other embodiments, such as illustrated in FIG. 2A, the first, second and third casing tubulars 220, 250, 290 comprise a single casing tubular.

Figure 2E:
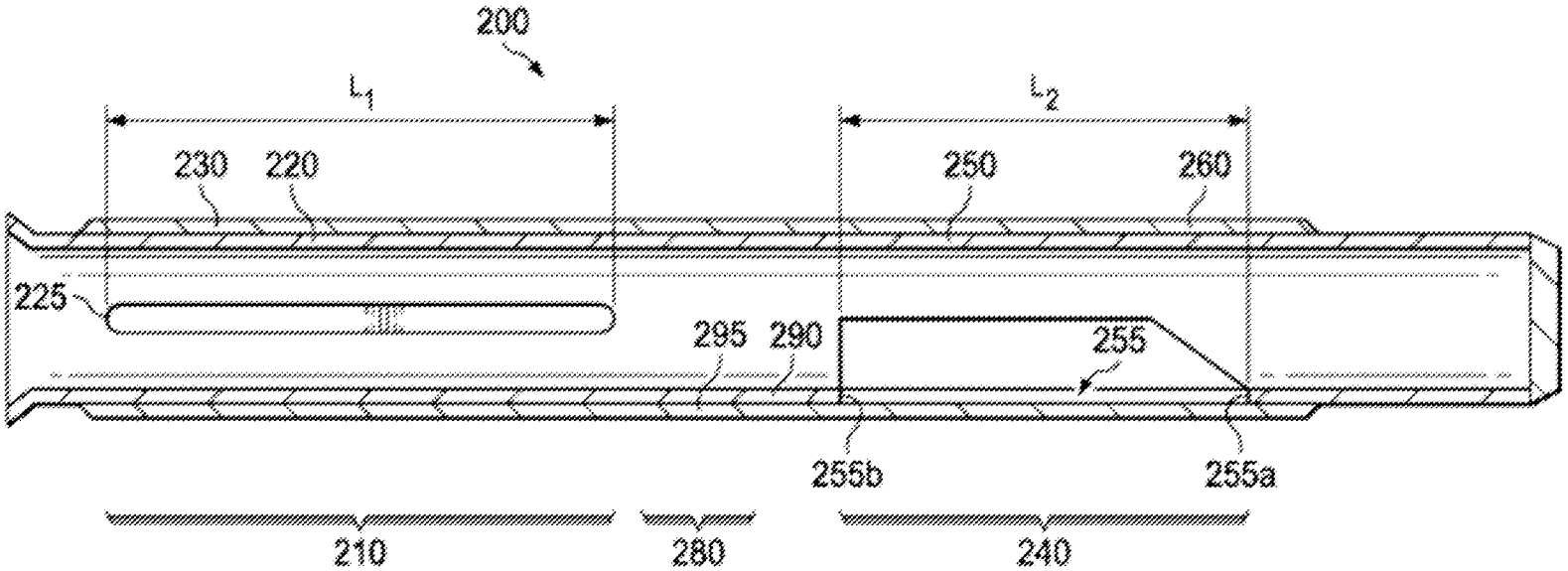

The casing alignment sub 280, in the illustrated embodiment of FIG. 2D, additionally includes a third outer sleeve 295 surrounding at least a portion of the third casing tubular 290. In other embodiments, the third outer sleeve 295 surrounds an entirety of the third casing tubular 290 FIG. 2E. The third outer sleeve 295 may comprise many different non-ferrous materials and remain within the scope of the disclosure. In another embodiment, the third outer sleeve 296 comprises a material having a lesser hardness rating than the third casing tubular 290. In one embodiment, the third outer sleeve 295 comprises aluminum or an alloy thereof. Notwithstanding, other materials for the third outer sleeve 295 are within the scope of the disclosure. In certain embodiments, such as that illustrated in FIG. 2A, the first, second and third outer sleeves 230, 260, 295 comprise three separate outer sleeves. In other embodiments, however, the first, second and third outer sleeves 230, 260, 295 comprise a single outer sleeve. (FIG. 2E).

Returning to FIG. 2D, illustrated is a cross sectional view of the casing alignment sub 280 taken through the line 2D-2D illustrated in FIG. 2A. The casing alignment sub 280 includes the third casing tubular 290 and the third outer sleeve 295.

Figure 3A:
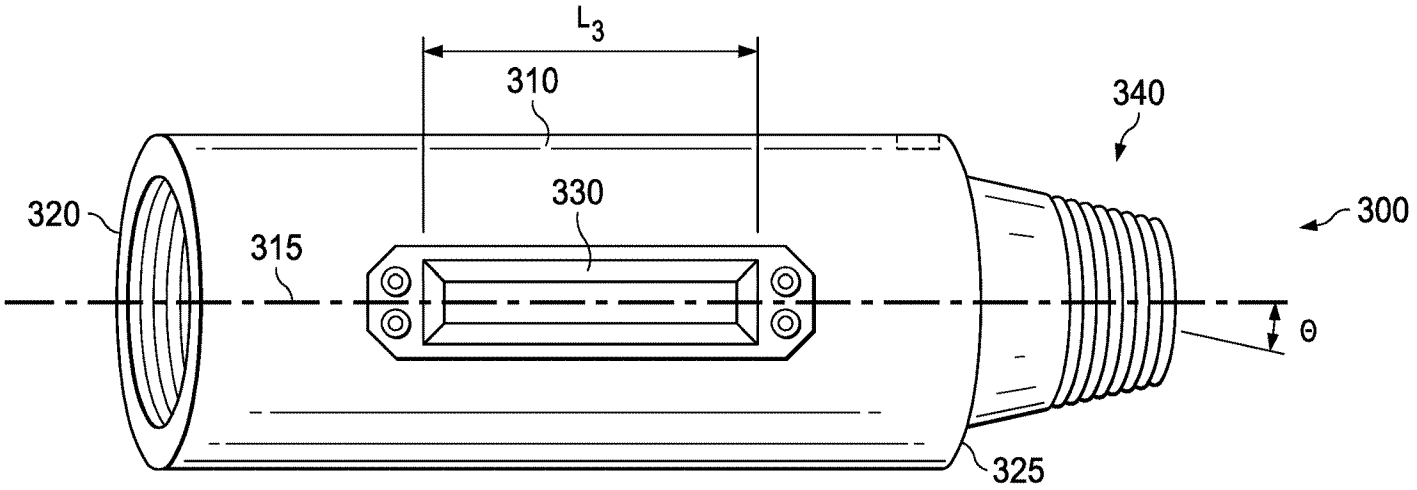
FIGS. 3A and 3B illustrate different views of an exit assembly designed, manufactured and operated according to one or more embodiments of the disclosure.
Figure 3B:
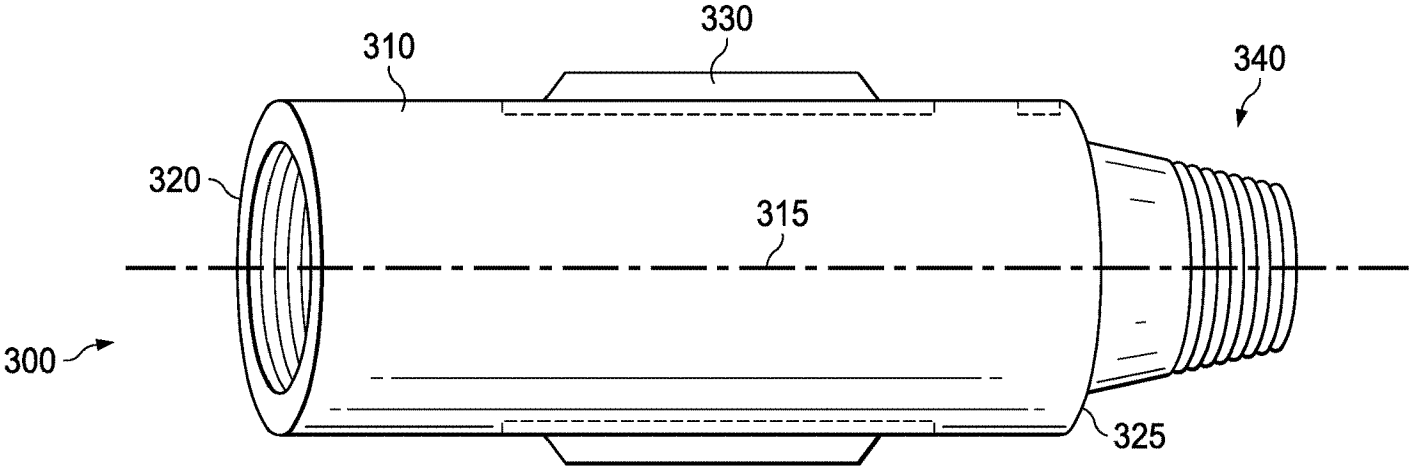

Turning to FIGS. 3A and 3B, illustrated are different views of an exit assembly 300 designed, manufactured and operated according to one or more embodiments of the disclosure. The exit assembly 300, in at least one embodiment, is configured to latch with a drillable window assembly (e.g., such as the drillable window assembly illustrate in FIG. 2A). Accordingly, the exit assembly, along with a drill bit coupled to a downhole end thereof, may be used to drill a lateral wellbore in a subterranean formation.

The exit assembly 300, in at least one embodiment, includes a tubular 310 defining a central axis 315. The tubular 310, in the illustrated embodiment, includes an uphole end 320 and a downhole end 325. The tubular 310 may comprise many different materials and remain within the scope of the disclosure. In the illustrated embodiment of FIGS. 3A and 3B, however, the tubular 310 is a metal tubular member, such as for example a steel tubular member.

The exit assembly 300, in the embodiment of FIGS. 3A and 3B, additionally includes two or more radially offset keys 330 along an exterior thereof (e.g., along the tubular 310). The two or more radially offset keys 330, in accordance with the disclosure, are configured to latch with two or more radially offset slots located along an interior of a first precut casing joint of a drillable window assembly (e.g., similar to the two or more radially offset slots 225 located along the interior of the first precut casing joint 210 of the drillable window assembly 200 illustrated in FIG. 2A). The two or more radially offset keys 330, in certain embodiments, have a shape similar to the two or more offset slots that they are configured to latch with. For example, in one embodiment, as shown, the two or more radially offset keys 330 have a rectangular shape. In other embodiments, the two or more radially offset keys 330 have a semi-circular shape, or in yet another embodiment another polygonal shape. Accordingly, unless otherwise required, a shape of the two or more radially offset keys 330 is not limited to one specific shape.

In one embodiment, the two or more radially offset keys 330 have a length ($L_3$). The length ($L_3$) may range from substantially an entire length of the tubular 310 to less than an entire length of the tubular 310. In certain embodiments, the length ($L_3$) is less than the length ($L_1$) of the two or more radially offset slots that the two or more radially offset keys 330 will latch with. In certain other embodiments, the length ($L_3$) is at least 20 percent less than the length ($L_1$). In yet other embodiments, the length ($L_3$) is at least 50 percent less than the length ($L_1$), or even yet the length ($L_3$) is at least 75 percent less than the length ($L_1$). Accordingly, when the two or more radially offset keys 330 are latched with their associated two or more radially offset slots, the two or more radially offset keys 330 may reciprocate back and forth within the two or more radially offset slots.

In certain embodiments, the two or more radially offset keys 330 are movable from a collapsed state (e.g., run in hole state) to an expanded state (e.g., operational state) to latch with the two or more radially offset slots in the first precut casing joint. For example, in certain embodiments the two or more radially offset keys 330 are spring loaded to move between the collapsed state and the expanded state. Other mechanisms for moving the two or more radially offset keys 330 between the collapsed state and the expanded state are within the scope of the disclosure.

In certain embodiments, the exit assembly 300 additionally includes an offset sub 340 located proximate the downhole end 325 of the tubular 310. The offset sub 340, in at least one embodiment, additionally includes an offset angle (θ) coupled to the drill bit. Accordingly, the offset angle (θ) may be used to drill a lateral wellbore having a wellbore exit angle (θ') substantially similar to the offset angle (θ). In certain embodiments, the offset angle (θ) ranges from 0.5 degrees to 5 degrees off of the central axis. Notwithstanding, other offset angles (θ) outside of this range are within the scope of the disclosure. In the illustrated embodiment, the offset sub 340 is a pin (e.g., as part of a pin and box coupling) coupled to the drill bit. In another embodiment, the offset sub 340 is a box (e.g., as part of a pin and box coupling) coupled to the drill bit.

Turning now to FIGS. 4 through 12, illustrated are cross-sectional views of a multilateral well 400 designed, manufactured and operated according to one or more embodiments of the disclosure. The multilateral well 400 illustrated in the embodiment of FIG. 4 includes a larger uphole casing section 410 (e.g., 9 ⅝") and a smaller downhole casing section 420 (e.g., 7 ⅝"). The multilateral well 400 additionally includes an open hole main wellbore section 430. For example, in the illustrated embodiment of FIG. 4, a drilling assembly 440 including a drill bit 450 is being deployed within the multilateral well 400 to form the main wellbore section 430.

Figure 4:
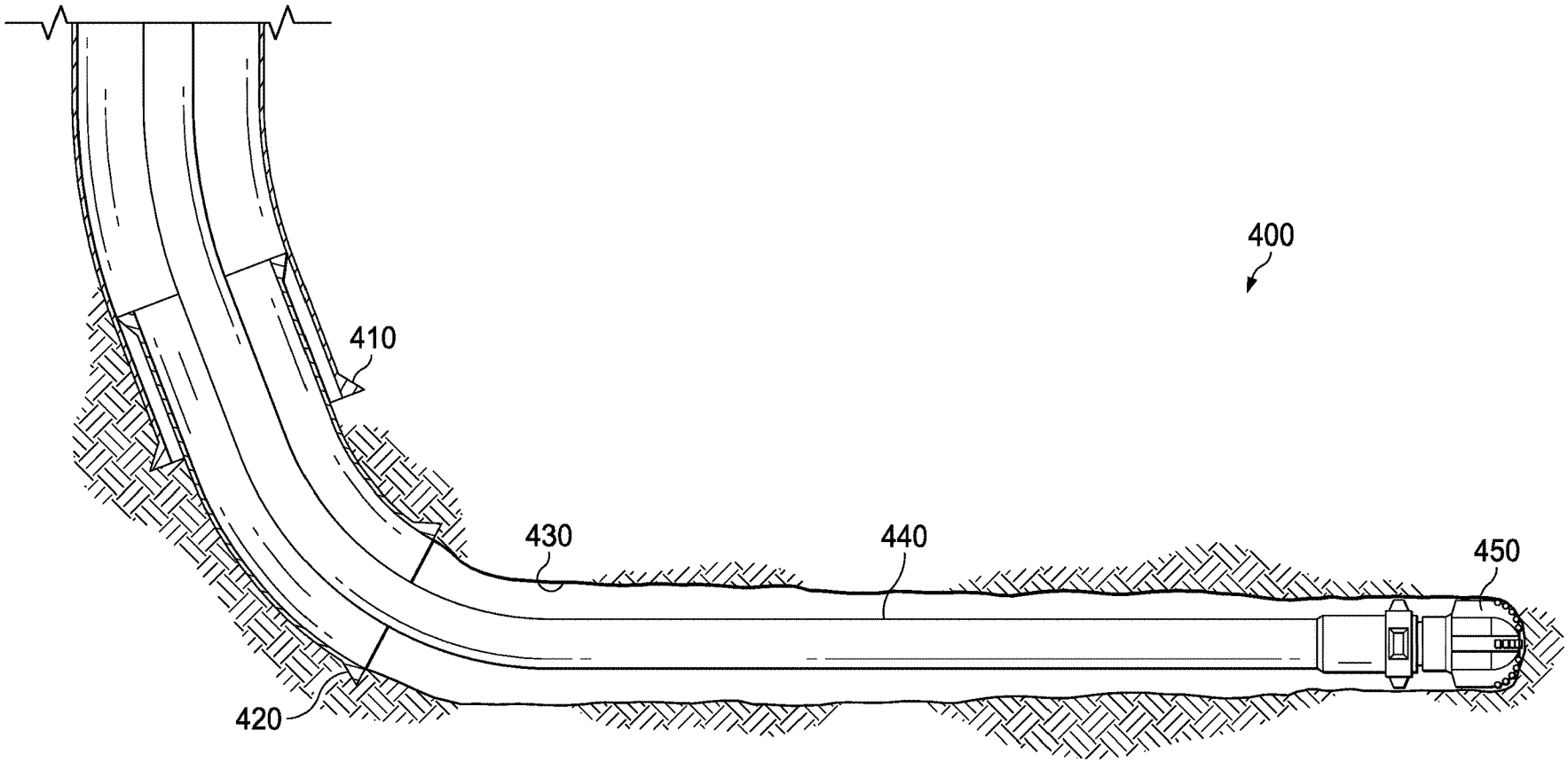
FIGS. 4 through 12 illustrate a variety of different enlarged views of one embodiment of a method for manufacturing a multilateral well according to the disclosure.
Figure 5:
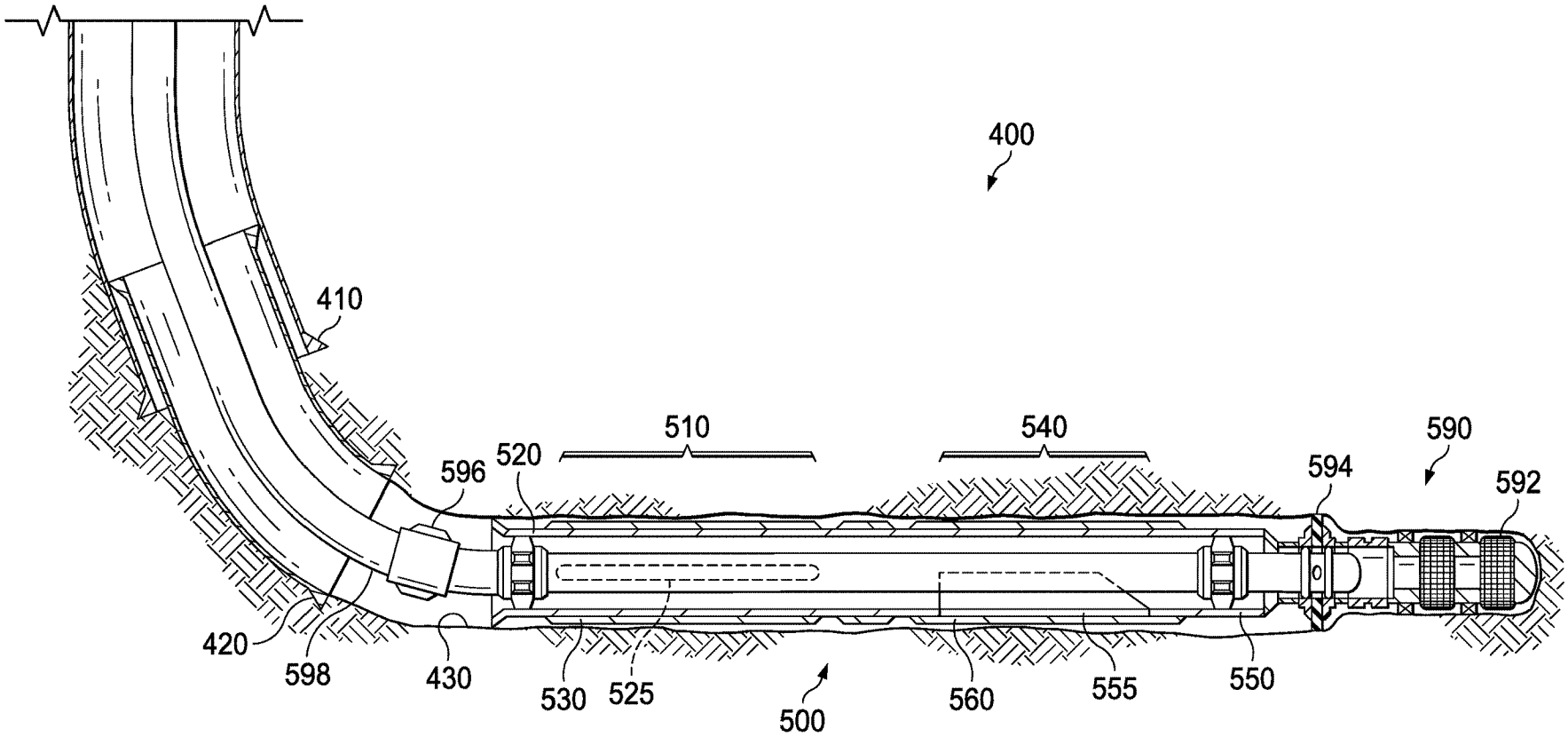

Turning to FIG. 5, illustrated is the multilateral well 400 of FIG. 4 after installing a drillable window assembly 500 and main wellbore completion 590 within the main wellbore section 430. In one or more embodiments, the main wellbore completion 590 includes wellbore screens 592 and an open hole anchor 594. In the illustrated embodiment, the drillable window assembly 500 and main wellbore completion 590 are positing in the main wellbore section 430 using a running tool 598. For example, the drillable window assembly 500 is positioned at a location in the main wellbore section 430 where it is desired to form a lateral wellbore. The drillable window assembly 500 may be similar to any of the drillable window assemblies discussed above, in addition to any other drillable window assemblies designed and manufactured according to the disclosure. Accordingly, in one or more embodiments, the drillable window assembly 500 may include: 1) a first precut casing joint 510, the first precut casing joint 510 including a first casing tubular 520 having two or more radially offset slots 525 along an interior surface thereof; 2) a second precut casing joint 540 coupled to the first precut casing joint 510, the second precut casing joint 540 including a second casing tubular 550 having a sidewall opening 555 formed therein; and 3) an outer sleeve 560 surrounding the sidewall opening 555 in the second casing tubular 550.

The drillable window assembly 500, in the illustrated embodiments, has been run in hole to a junction depth. Similarly, the drillable window assembly 500 illustrated in FIG. 5 has been oriented with the sidewall opening 555 positioned proximate a low side of the main wellbore 430. For example, a wellbore orientation tool 596 may be used to appropriately position the sidewall opening 555 proximate the low side of the main wellbore 430.

Figure 6:
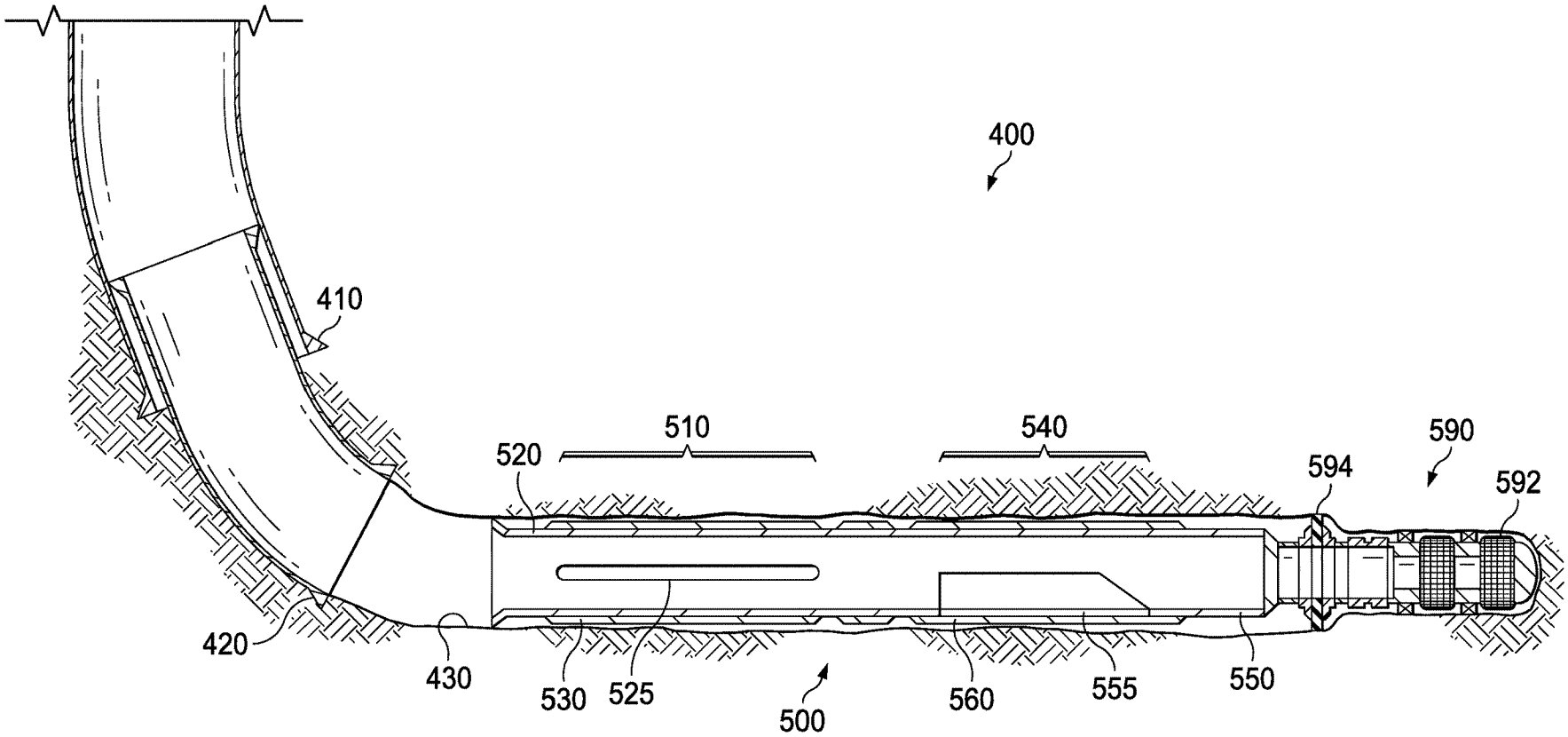

Turning to FIG. 6, illustrated is the multilateral well 400 of FIG. 5 after pressuring up on the running tool 598 to set the open hole anchor 594. Accordingly, the drillable window assembly 500 is fixed at a desired location in the main wellbore 430. Thereafter, the running tool 598 would release from the drillable window assembly 500 and then be pulled out of hole. In the illustrated embodiment, the drillable window assembly 500 and main wellbore completion 590 remain within the main wellbore 430.

Figure 7:
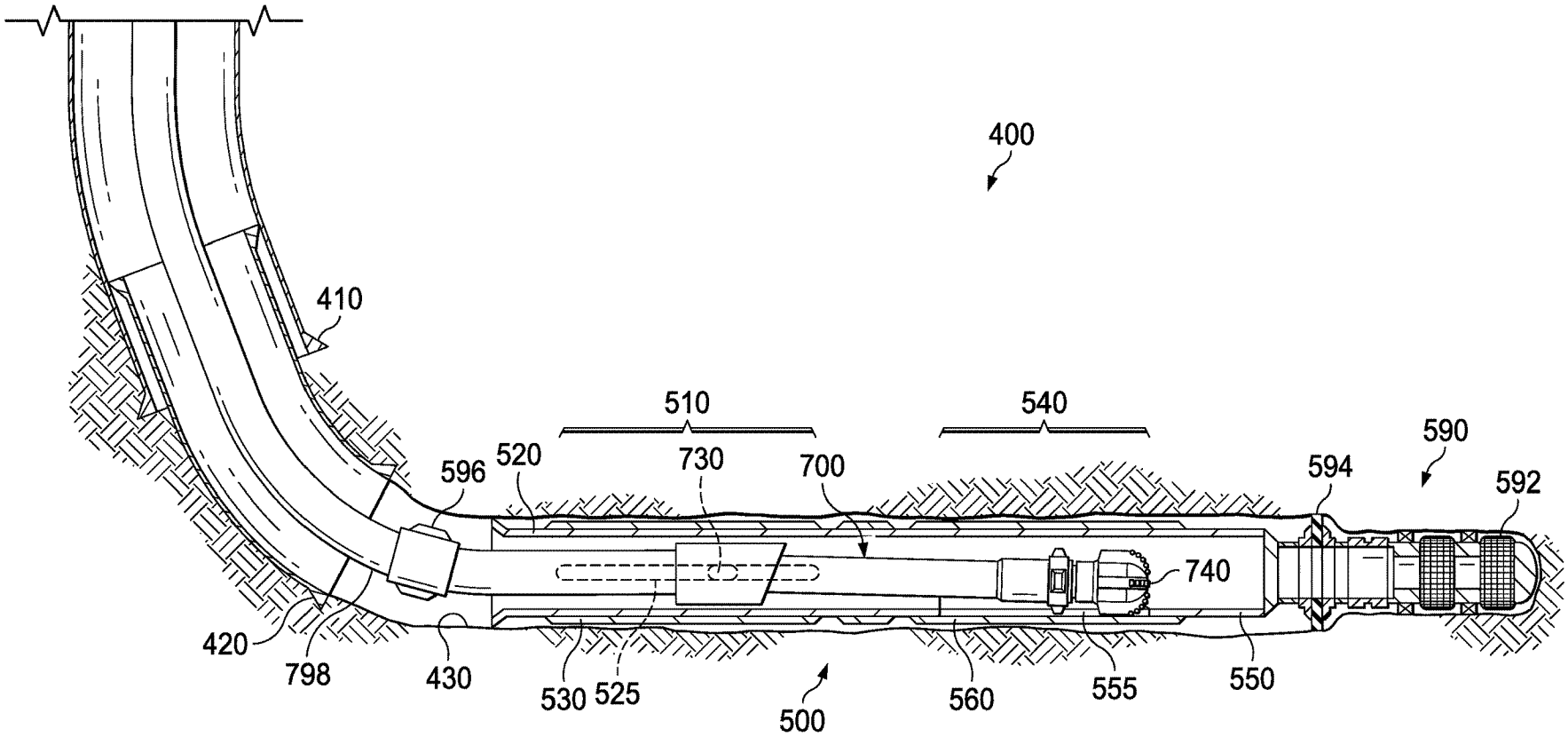

Turning to FIG. 7, illustrated is the multilateral well 400 of FIG. 6 after running an exit assembly 700 downhole toward the drillable window assembly 500. In the illustrated embodiment of FIG. 7, the exit assembly 700 includes a tubular defining a central axis, two or more radially offset keys 730 along an exterior thereof, and a drill bit 740 coupled to a downhole end thereof. In accordance with one or more embodiments, the exit assembly 700 includes an offset sub located proximate a downhole end of the tubular, the offset sub additionally including an offset angle (θ) coupled to the drill bit. For example, the offset angle (θ) may in certain embodiments range from 0.5 degrees to 5 degrees off of the central axis. The exit assembly 700 may additionally include a weighted bit sub (WBS) to enhance the cutting side force and drop tendency of the exit assembly 700.

In the illustrated embodiment, the exit assembly 700 has been run in hole with a running tool 798. With the exit assembly 700 in the drillable window assembly 500, the exit assembly 700 may be rotated until the two or more radially offset keys 730 latch with the two or more radially offset slots 525 in the first casing tubular 520. In the illustrated embodiment, with the two or more radially offset keys 730 latched within the two or more radially offset slots 525, the drill bit may be positioned proximate a downhole end of the sidewall opening 555.

Figure 8:
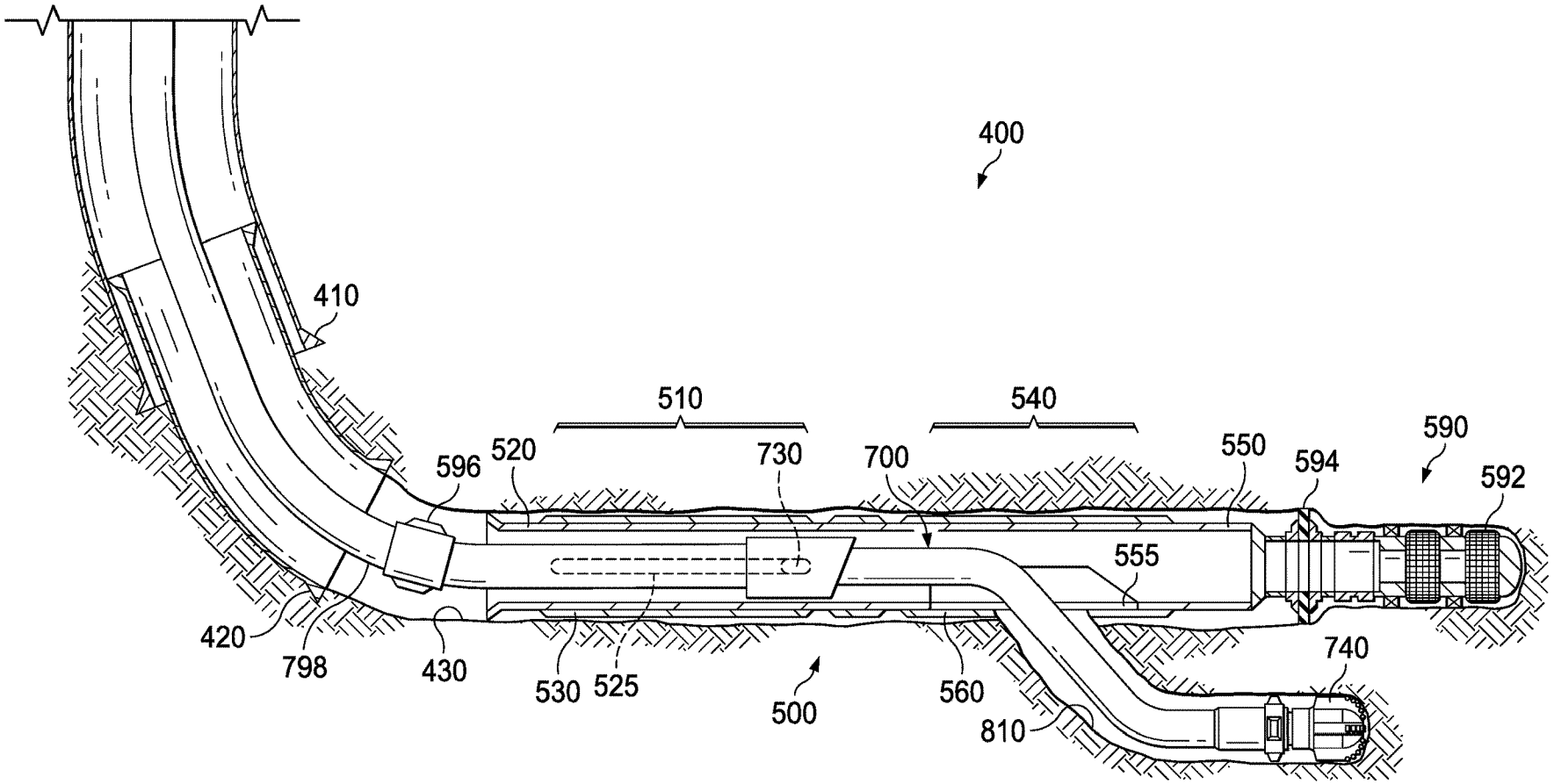

Turning to FIG. 8, illustrated is the multilateral well 400 of FIG. 7 after rotating the drill bit 740 of the exit assembly 700 along the sidewall opening 555 in the second casing tubular 550 while the two or more radially offset keys 730 are latched with the two or more radially offset slots 525. In certain embodiments, the exit assembly 700 includes a mud motor assembly for driving/rotating the drill bit 740, so that rotation of the drill string from surface is not needed to rotate the drill bit 740. In other embodiments, the drill bit 740 is rotated from the surface. What results is a portion of a lateral wellbore, or a rat hole 810, in the subterranean formation. In certain embodiments, the drill bit 740 is reciprocated back and forth within the drillable window assembly 500 while it is rotating, thereby forming the rat hole 810. In other embodiments, the drill bit 740 is rotated and reciprocated back and forth proximate the downhole end of the sidewall opening 555 for a first period of time, before it is rotated and reciprocated back and forth proximate an uphole end of the sidewall opening 555 for a second period of time. In certain embodiments, the drill bit 740 is rotated and reciprocated back and forth along an entire length of the sidewall opening 555 for the second period of time.

In one embodiment, after a prescribed amount of time and number of strokes, the length of the reciprocation will increase relative to the end of the sidewall opening 555. This may be done systematically until the drill bit 740 has reached the predetermined uphole end of the sidewall opening 555. This process will yield a low side exit with no roll off, deeper at the bottom of the cut relative to the top of the cut. Once the predetermined reciprocations are completed, the exit assembly 700 can return to the downhole end of the sidewall opening 555 to see if it takes weight. At this point there will be a definite low side ledge created in the new formation outside of the pre-milled window. The exit assembly 700 will continue until the two or more radially offset keys 730 bottom out at the end of the two or more radially offset slots 525, which will provide the rat hole 810 having a predetermined length.

Figure 9:
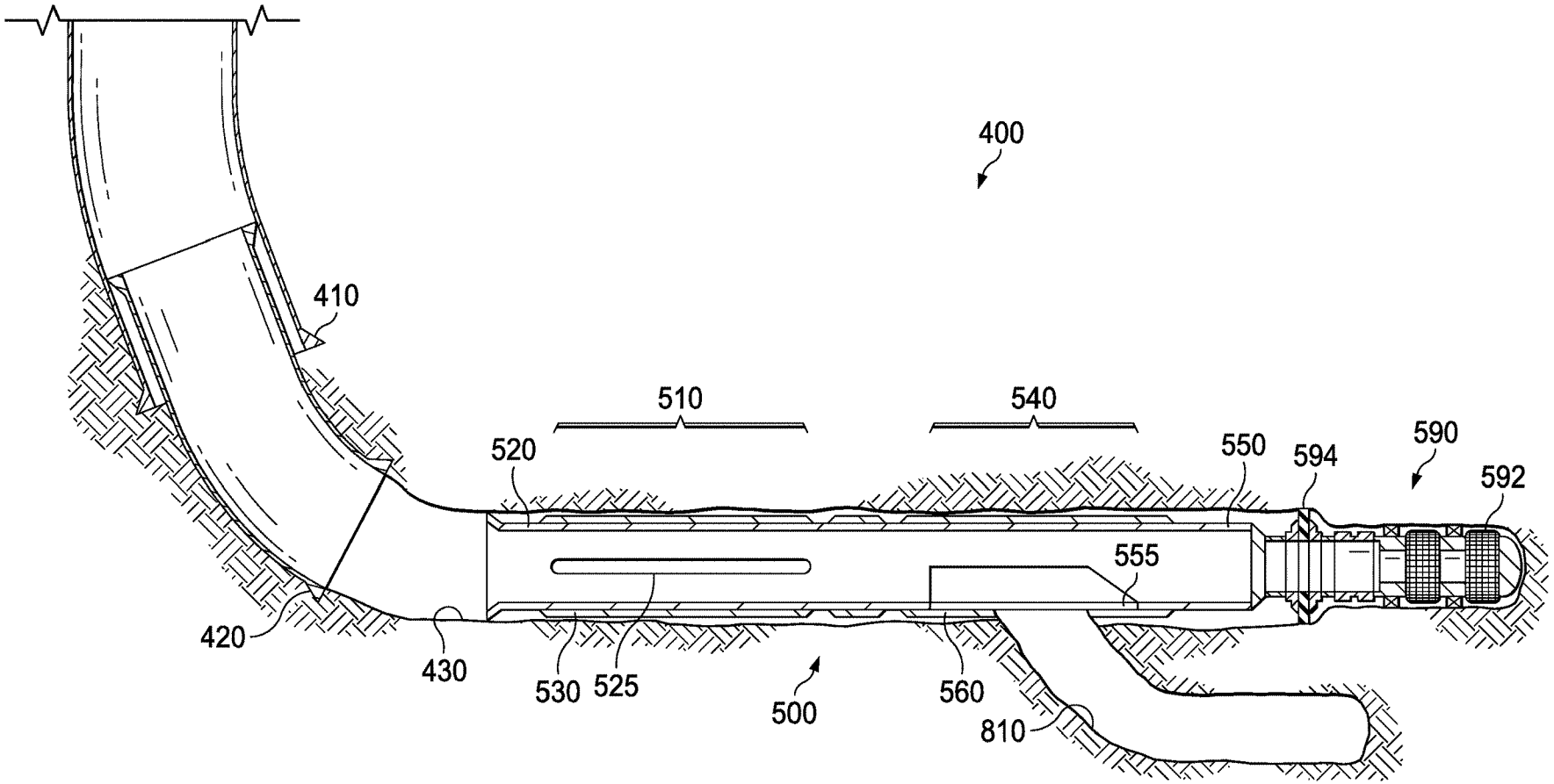

Turning to FIG. 9, illustrated is the multilateral well 400 of FIG. 8 after pulling the exit assembly 710 and drill bit 740 out of the main wellbore 430. Again, what remains is the rat hole 810 extending at least partially from the main wellbore 430.

Figure 10:
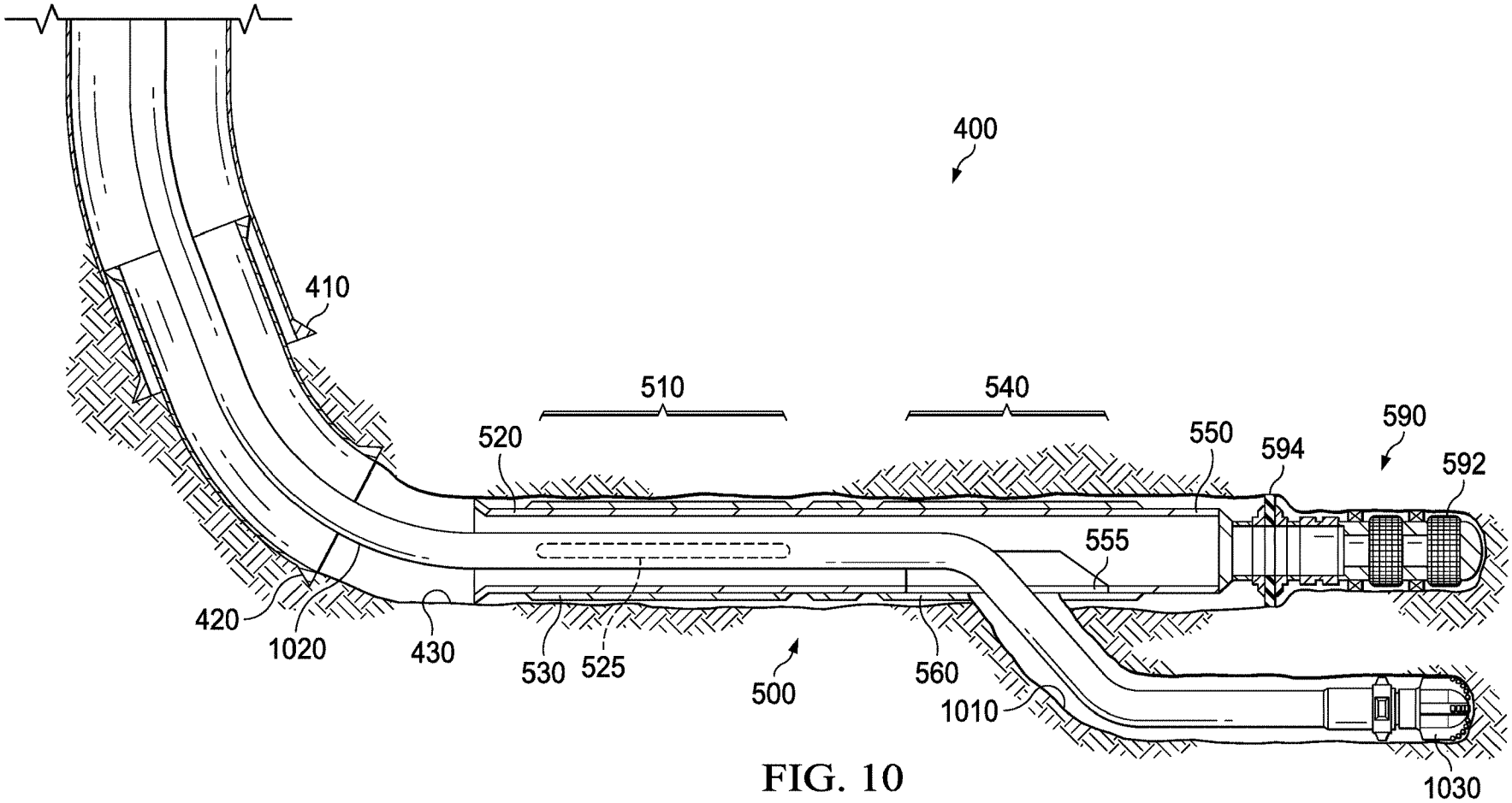

Turning to FIG. 10, illustrated is the multilateral well 400 of FIG. 9 after drilling the lateral wellbore 1010 to depth with a drilling assembly 1020 having a drill bit 1030. In the illustrated embodiment, the drill bit 1030 will naturally follow the gentle low side exit path created by the exit assembly 700 without need for significant (or any) deflection.

Figure 11:
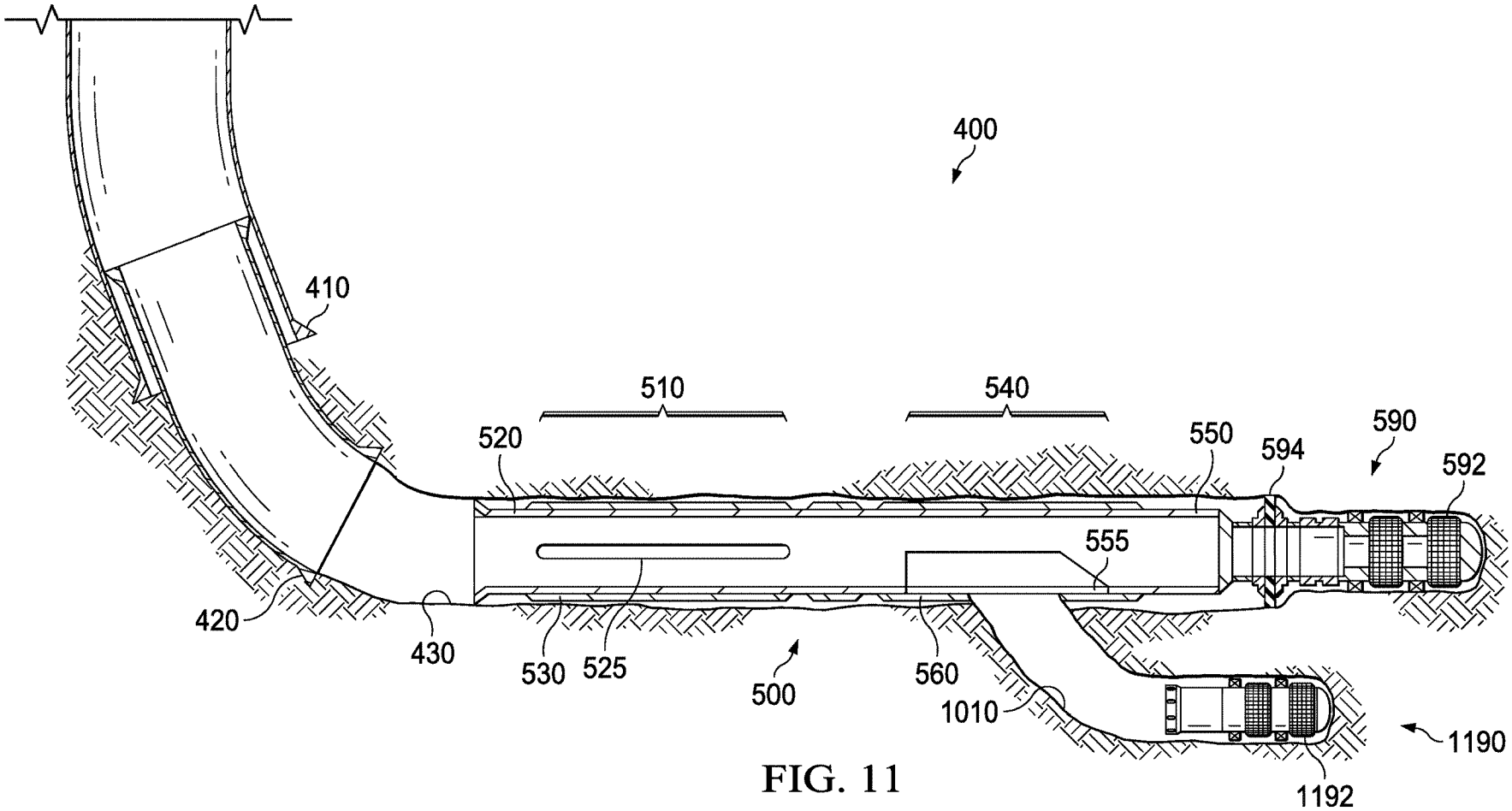

Turning to FIG. 11, illustrated is the multilateral well 400 of FIG. 10 after pulling the drilling assembly 1020 out of hole from the lateral wellbore 1010 and the main wellbore 430. Thereafter, a lateral wellbore completion 1190 may be positioned within the lateral wellbore 1010. In at least one embodiment, the lateral wellbore completion 1190 includes screens 1192. In certain embodiment, the lateral wellbore completion 1190 includes a multilateral window with integral deflector.

Figure 12:
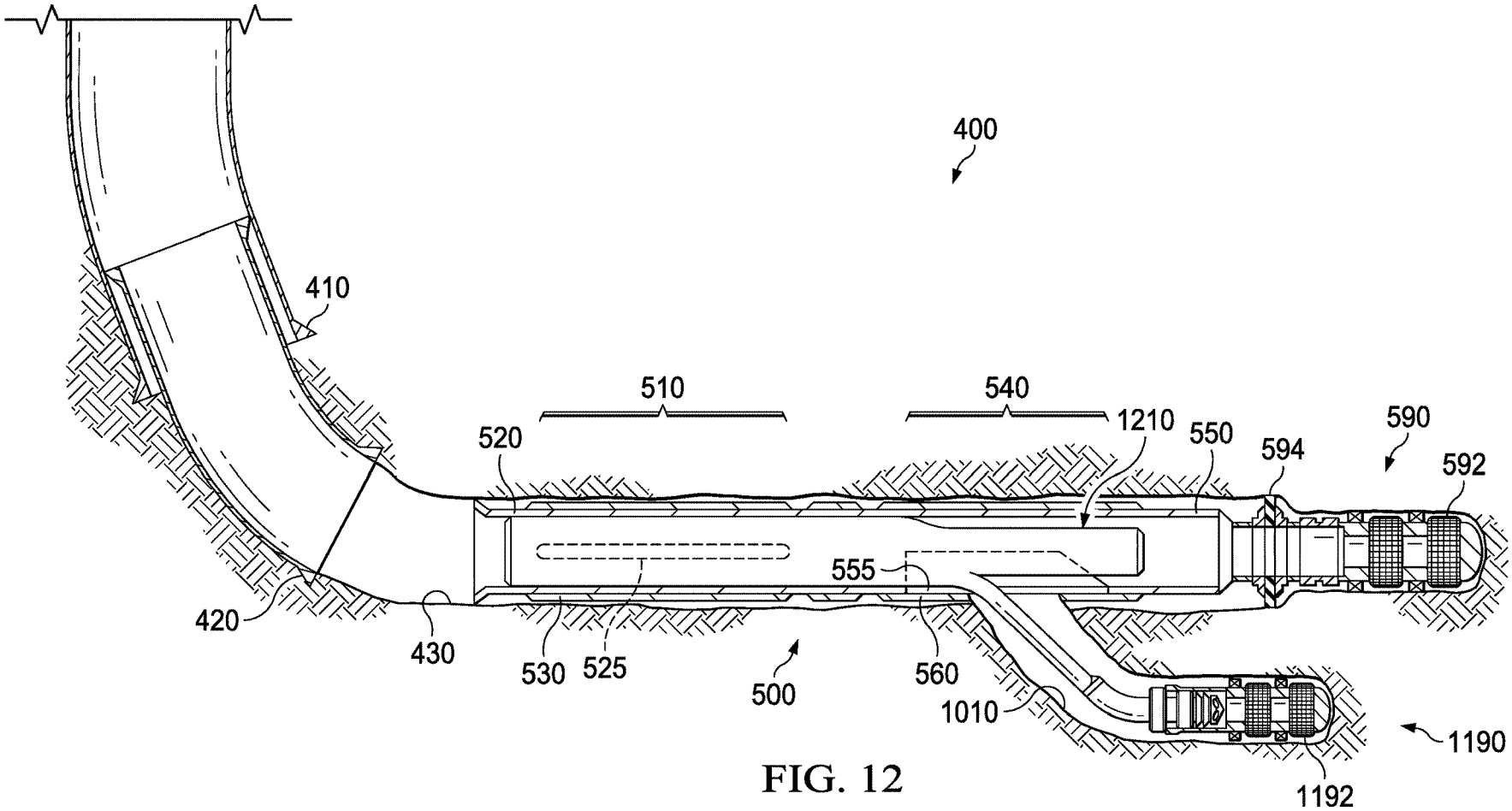

Turning to FIG. 12, illustrated is the multilateral well 400 of FIG. 11 after positioning a production assembly 1210 proximate both the main wellbore completion 590 in the main wellbore 430 and the lateral wellbore completion 1190 in the lateral wellbore 1010. At this stage, the multilateral well 400 is ready for production.

Figure 13:
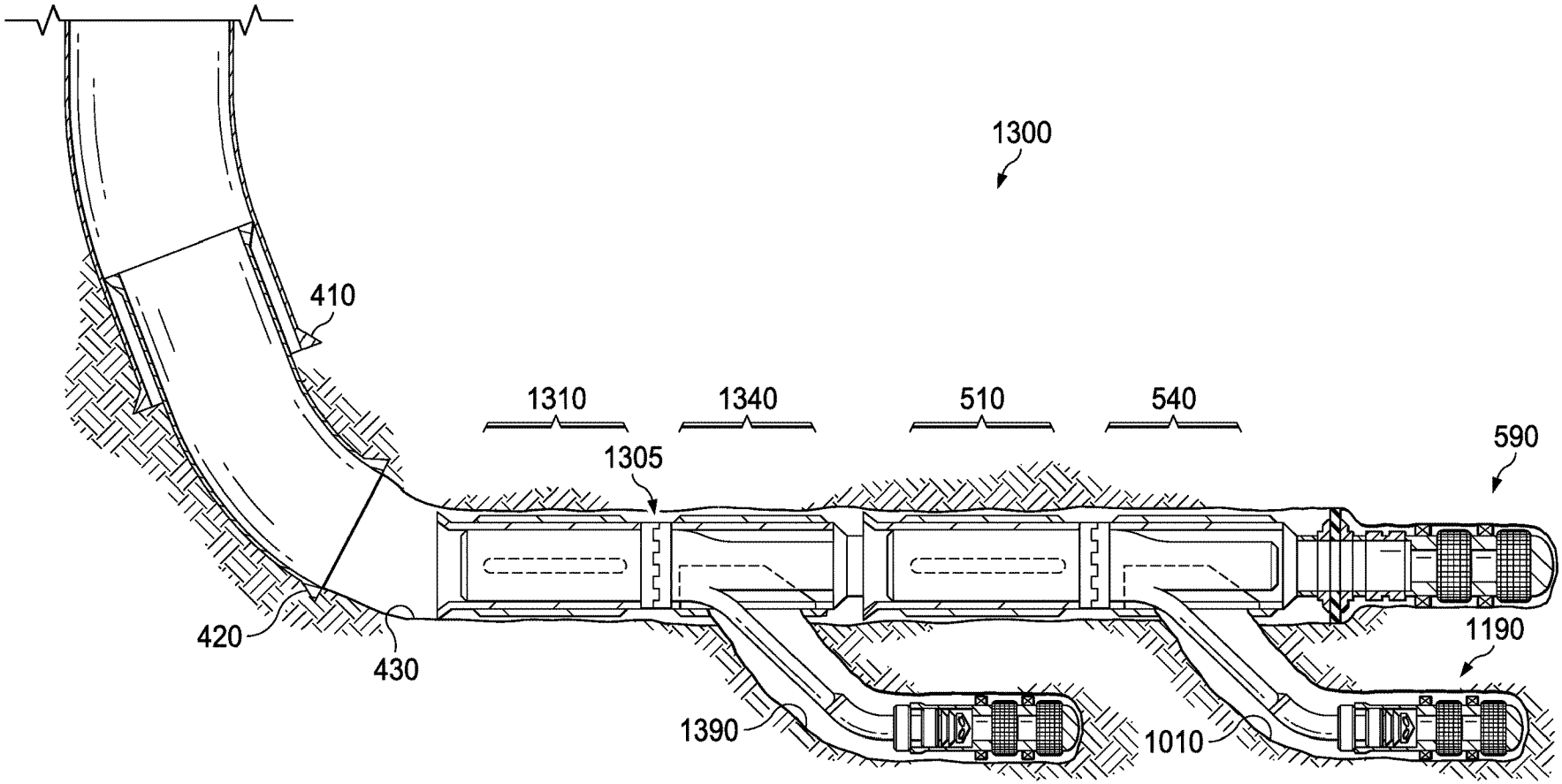
FIG. 13 illustrates an alternative multilateral well designed, manufactured and operated according to one embodiment of the disclosure.

Turning to FIG. 13, illustrated is an alternative embodiment of a multilateral well 1300 designed, manufactured and operated according to one or more embodiments of the disclosure. The multilateral well 1300 is similar in many respect to the multilateral well 400. Accordingly, like reference numbers have been used to represent similar (if not identical) features. The multilateral well 1300 differs for the most part from the multilateral well 400, in that its drillable window assembly 1305 includes: 1) a third precut casing joint 1310, the third precut casing joint 1310 including a third casing tubular having two or more additional radially offset slots along an interior surface thereof; 2) a fourth precut casing joint 1340 coupled to the third precut casing joint, the fourth precut casing joint 1340 including a fourth casing tubular having a second sidewall opening formed therein; and 3) a second outer sleeve surrounding at least a portion of the second sidewall opening and exposing the second sidewall opening to the second lateral wellbore 1390. While only two lateral wellbores 1010 and 1390 are illustrated in the embodiment of FIG. 13, the present disclosure may be expanded to any number of lateral wellbores.

A device designed, manufactured and operated according to the present disclosure includes many advantages, including: elimination of the trip in the hole to run in the hole and latch the whipstock; elimination of the trip in the hole to pull the whipstock out of the hole; elimination of the trip in the hole to run a completion deflector; elimination of early or late window exits as window drill out now geometrically controlled; elimination of high dog leg severities across a window exit; elimination of the cost of the whipstocks and milling assemblies plus the associated back up equipment needed for these assemblies.

In contrast to existing devices and methods, the present disclosure employs no whipstock or angled deflection device to create the sidetrack and exit from the window joint, whilst still maintaining the geometry control necessary for multilateral construction and completion solutions. This solution also gives a permanent depth and orientation reference while providing a milling/drilling guide without a reduction in well bore ID allowing for the potential to stack the junctions for tri and quad lateral installations. Additionally, the low-side low angle departure is beneficial for "in reservoir" junctions and may be used for unconventional stimulation applications with MLT construction.

The tools and methods being described in this application, are not limited to the unconventional well market, as they could also be employed for conventional multilateral wellbore construction in any and all applications and environments. The tools and methods described are aimed at reducing the overall number of trips/operations required to construct a multilateral junction, hence, reduction in multilateral junction construction time and therefore cost, would be applicable in any wellbore construction scenario, both unconventional and conventional.

Aspects disclosed herein include:

A. A drillable window assembly, the drillable window assembly including: 1) a first precut casing joint, the first precut casing joint including a first casing tubular having two or more radially offset slots along an interior surface thereof; 2) a second precut casing joint coupled to the first precut casing joint, the second precut casing joint including a second casing tubular having a sidewall opening formed therein; and 3) an outer sleeve surrounding the sidewall opening in the second casing tubular.

B. A method for forming a multilateral well, the method including: 1) placing a drillable window assembly within a main wellbore located in a subterranean formation, the drillable window assembly including a first precut casing joint, the first precut casing joint including a first casing tubular having two or more radially offset slots along an interior surface thereof, a second precut casing joint coupled to the first precut casing joint, the second precut casing joint including a second casing tubular having a sidewall opening formed therein, and an outer sleeve surrounding the sidewall opening in the second casing tubular; 2) running an exit assembly downhole toward the drillable window assembly, the exit assembly including a tubular defining a central axis, two or more radially offset keys along an exterior thereof and a drill bit coupled to a downhole end thereof; 3) rotating the exit assembly within the drillable window assembly until the two or more radially offset keys latch with the two or more radially offset slots in the first casing tubular; and 4) rotating the drill bit of the exit assembly along the sidewall opening in the second casing tubular while the two or more radially offset keys are latched with the two or more radially offset slots to form a lateral wellbore in the subterranean formation.

C. A multilateral well, the multilateral well including: 1) a main wellbore; 2) a lateral wellbore extending from the main wellbore; and 3) a drillable window assembly positioned at a junction between the main wellbore and the lateral wellbore, the drillable window assembly including a first precut casing joint, the first precut casing joint including a first casing tubular having two or more radially offset slots along an interior surface thereof, a second precut casing joint coupled to the first precut casing joint, the second precut casing joint including a second casing tubular having a sidewall opening formed therein, and an outer sleeve surrounding the sidewall opening in the second casing tubular.

Aspects A, B, and C may have one or more of the following additional elements in combination: Element 1: wherein a radial centerpoint of the sidewall opening is substantially equally radially offset from two of the two or more radially offset slots. Element 2: wherein the outer sleeve is a non-ferrous outer sleeve that surrounds an entirety of the second casing tubular. Element 3: further including a second non-ferrous outer sleeve surrounding an entirety of the first casing tubular. Element 4: wherein the outer sleeve and the second outer sleeve are a single outer sleeve. Element 5: wherein a length ($L_2$) of the sidewall opening is at least 20 percent of a length of the second casing tubular. Element 6: wherein the outer sleeve includes an internal cutaway relief proximate the sidewall opening. Element 7: wherein the internal cutaway relief is a reduced sidewall thickness of the outer sleeve proximate the sidewall opening. Element 8: wherein the internal cutaway relief is an outer sleeve slot located along an inner surface of the outer sleeve. Element 9: further including a casing alignment sub coupled between the first precut casing joint and the second precut casing joint. Element 10: wherein rotating the drill bit includes rotating the drill bit while the exit assembly is reciprocated back and forth within the drillable window assembly. Element 11: wherein the exit assembly includes an offset sub located proximate a downhole end of the tubular, the offset sub additionally including an offset angle (θ) coupled to the drill bit. Element 12: wherein the offset angle (θ) ranges from 0.5 degrees to 5 degrees off of the central axis. Element 13: wherein the two or more laterally offset keys are movable from a collapsed state to an expanded state to latch with the two or more radially offset slots in the first casing tubular. Element 14: wherein placing a drillable window assembly includes placing a drillable window assembly with the sidewall opening positioned proximate a low side of the main wellbore. Element 15: further including positioning the drill bit proximate a downhole end of the sidewall opening prior to rotating the drill bit, and further including rotating the drill bit while the exit assembly is reciprocated back and forth proximate the downhole end of the sidewall opening for a first period of time, before rotating the drill bit while the exit assembly is reciprocated back and forth proximate an uphole end of the sidewall opening for a second period of time. Element 16: wherein rotating the drill bit while the exit assembly is reciprocated back and forth proximate an uphole end of the sidewall opening for a second period of time includes rotating and reciprocating the drill bit along an entire length of the sidewall opening for the second period of time. Element 1: wherein the lateral wellbore is a first lateral wellbore, and further including a second lateral wellbore extending from the main wellbore uphole of the first lateral wellbore, and further wherein the drillable window assembly includes a third precut casing joint, the third precut casing joint including a third casing tubular having two or more additional radially offset slots along an interior surface thereof, a fourth precut casing joint coupled to the third precut casing joint, the fourth precut casing joint including a fourth casing tubular having a second sidewall opening formed therein, and a second outer sleeve surrounding at least a portion of the second sidewall opening and exposing the second sidewall opening to the second lateral wellbore.

Those skilled in the art to which this application relates will appreciate that other and further additions, deletions, substitutions and modifications may be made to the described embodiments.

What is claimed is:

1. A drillable window assembly, comprising:

a first precut casing joint, the first precut casing joint including a first casing tubular having two or more radially offset slots along an interior surface thereof, wherein the two or more radially offset slots are positioned equidistance around the first casing tubular;

a second precut casing joint coupled to the first precut casing joint, the second precut casing joint including a second casing tubular having a sidewall opening formed therein; and an outer sleeve surrounding the sidewall opening in the second casing tubular.

2. The drillable window assembly as recited in claim 1, wherein a radial centerpoint of the sidewall opening is substantially equally radially offset from two of the two or more radially offset slots.

3. The drillable window assembly as recited in claim 1, wherein the outer sleeve is a non-ferrous outer sleeve that surrounds an entirety of the second casing tubular.

4. The drillable window assembly as recited in claim 3, further including a second non-ferrous outer sleeve surrounding an entirety of the first casing tubular.

5. The drillable window assembly as recited in claim 4, wherein the outer sleeve and the second outer sleeve are a single outer sleeve.

6. The drillable window assembly as recited in claim 1, wherein a length ($L_2$) of the sidewall opening is at least 20 percent of a length of the second casing tubular.

7. The drillable window assembly as recited in claim 1, wherein the outer sleeve includes an internal cutaway relief proximate the sidewall opening.

8. The drillable window assembly as recited in claim 7, wherein the internal cutaway relief is a reduced sidewall thickness of the outer sleeve proximate the sidewall opening.

9. The drillable window assembly as recited in claim 7, wherein the internal cutaway relief is an outer sleeve slot located along an inner surface of the outer sleeve.

10. The drillable window assembly as recited in claim 1, further including a casing alignment sub coupled between the first precut casing joint and the second precut casing joint.

11. A method for forming a multilateral well, comprising:

placing a drillable window assembly within a main wellbore located in a subterranean formation, the drillable window assembly including;

a first precut casing joint, the first precut casing joint including a first casing tubular having two or more radially offset slots along an interior surface thereof, wherein the two or more radially offset slots are positioned equidistance around the first casing tubular;

a second precut casing joint coupled to the first precut casing joint, the second precut casing joint including a second casing tubular having a sidewall opening formed therein; and an outer sleeve surrounding the sidewall opening in the second casing tubular;

running an exit assembly downhole toward the drillable window assembly, the exit assembly including a tubular defining a central axis, two or more radially offset keys along an exterior thereof and a drill bit coupled to a downhole end thereof;

rotating the exit assembly within the drillable window assembly until the two or more radially offset keys latch with the two or more radially offset slots in the first casing tubular; and rotating the drill bit of the exit assembly along the sidewall opening in the second casing tubular while the two or more radially offset keys are latched with the two or more radially offset slots to form a lateral wellbore in the subterranean formation.

12. The method as recited in claim 11, wherein rotating the drill bit includes rotating the drill bit while the exit assembly is reciprocated back and forth within the drillable window assembly.

13. The method as recited in claim 11, wherein the exit assembly includes an offset sub located proximate a downhole end of the tubular, the offset sub additionally including an offset angle (θ) coupled to the drill bit.

14. The method as recited in claim 13, wherein the offset angle (θ) ranges from 0.5 degrees to 5 degrees off of the central axis.

15. The method as recited in claim 11, wherein the two or more laterally offset keys are movable from a collapsed state to an expanded state to latch with the two or more radially offset slots in the first casing tubular.

16. The method as recited in claim 11, wherein placing the drillable window assembly includes placing the drillable window assembly with the sidewall opening positioned proximate a low side of the main wellbore.

17. The method as recited in claim 11, further including positioning the drill bit proximate a downhole end of the sidewall opening prior to rotating the drill bit, and further including rotating the drill bit while the exit assembly is reciprocated back and forth proximate the downhole end of the sidewall opening for a first period of time, before rotating the drill bit while the exit assembly is reciprocated back and forth proximate an uphole end of the sidewall opening for a second period of time.

18. The method as recited in claim 17, wherein rotating the drill bit while the exit assembly is reciprocated back and forth proximate the uphole end of the sidewall opening for the second period of time includes rotating and reciprocating the drill bit along an entire length of the sidewall opening for the second period of time.

19. A multilateral well, comprising:

a main wellbore;

a lateral wellbore extending from the main wellbore; and a drillable window assembly positioned at a junction between the main wellbore and the lateral wellbore, the drillable window assembly including;

a first precut casing joint, the first precut casing joint including a first casing tubular having two or more radially offset slots along an interior surface thereof, wherein the two or more radially offset slots are positioned equidistance around the first casing tubular;

a second precut casing joint coupled to the first precut casing joint, the second precut casing joint including a second casing tubular having a sidewall opening formed therein; and an outer sleeve surrounding the sidewall opening in the second casing tubular.

20. The multilateral well as recited in claim 19, wherein the lateral wellbore is a first lateral wellbore, and further including a second lateral wellbore extending from the main wellbore uphole of the first lateral wellbore, and further wherein the drillable window assembly includes;

a third precut casing joint, the third precut casing joint including a third casing tubular having two or more additional radially offset slots along an interior surface thereof;

a fourth precut casing joint coupled to the third precut casing joint, the fourth precut casing joint including a fourth casing tubular having a second sidewall opening formed therein; and a second outer sleeve surrounding at least a portion of the second sidewall opening and exposing the second sidewall opening to the second lateral wellbore.

* * * * *